US006408534B1

(12) United States Patent
Alen et al.

(10) Patent No.: US 6,408,534 B1
(45) Date of Patent: Jun. 25, 2002

(54) STEAM BOX

(75) Inventors: Jukka-Pekka Alen, Jyväskylä; Reijo Hassinen, Leppävesi; Tapio Härkönen, Vaaiakoski; Tommi Luosma, Jyväskylä; Tuomas Näätänen, Jyväskylä; Jukka Samppala, Jyväskylä, all of (FI)

(73) Assignee: Metso Paper Automation Oy, Tampere (FI)

( * ) Notice: Subject to any disclaimer, the term of this patent is extended or adjusted under 35 U.S.C. 154(b) by 0 days.

(21) Appl. No.: 09/644,951

(22) Filed: Aug. 23, 2000

(30) Foreign Application Priority Data

Sep. 6, 1999 (FI) ..... 990372 U

(51) Int. Cl.[7] ..... D06F 58/00

(52) U.S. Cl. ..... 34/114; 34/119; 34/122; 34/124; 34/130

(58) Field of Search ..... 34/114, 119, 122, 34/124, 130

(56) References Cited

U.S. PATENT DOCUMENTS 3,971,235 A * 7/1976 Frezza ..... 68/5 E
4,351,700 A * 9/1982 Dove ..... 162/252
4,398,355 A * 8/1983 Dove ..... 34/54
4,543,737 A * 10/1985 Boissevain ..... 34/92
4,662,398 A 5/1987 Wywailowski
4,915,788 A * 4/1990 Winheim ..... 162/207
5,077,913 A 1/1992 Akerblom et al.
5,416,980 A * 5/1995 Ilvespaa ..... 34/117
5,711,087 A * 1/1998 Pazdera ..... 34/114
5,752,324 A 5/1998 Muller et al.

* cited by examiner

*Primary Examiner*—Ira S. Lazarus
*Assistant Examiner*—Kathryn S. O'Malley
(74) *Attorney, Agent, or Firm*—Fildes & Outland, P.C.

(57) ABSTRACT

A steam box includes a elongated steam-distribution chamber, regulator chambers set in a row next to the elongated steam-distribution chamber and covered on one side with a continuous perforated screen. Operating devices distribute the steam from the distribution chamber to each regulator chamber. The steam box is intended to feed steam through the perforated screen to the web, to heat it according to a desired profile. The perforated screen is secured along one long edge to hinge members and along the opposite edge to locking members and is arranged to be able to be opened, to permit access to the regulator chambers.

10 Claims, 3 Drawing Sheets

STEAM BOX

FIELD OF THE INVENTION

The present invention relates to a steam box, which includes an elongated steam-distribution chamber, regulator chambers set in a row next to this and covered on one side with a continuous perforated screen, and operating devices to distribute the steam from the distribution chamber to each regulator chamber, and which steam box is intended to feed steam through the perforated screen to the web, to heat it according to the desired profile.

BACKGROUND OF THE INVENTION

U.S. Pat. No. 5,711,087 (Pazdera) discloses a heating device for heating a web. Steam or hot air is fed to the web from a elongated chamber through a perforated screen conforming to the shape of the web. The screen easily dirties in use and must be cleaned. To facilitate this cleaning, the perforated screen is arranged to be detachable, in such a way that both of its long sides are attached to the frame of the apparatus by means of clip members.

The width of the regulator chambers of modern profiling steam boxes can be as little as 60mm, which permits a precise heating profile over the width of the web. A relatively common construction is one, in which each regulator chamber is equipped with a condensation water removal muff pipe, through which the water flows to the casing space, from which it is removed separately. One end of the muff is normally closed with a plug, but during maintenance the plug is removed, opening the condensing water channel through the muff. This is quite laborious, while it is impossible to gain access to the whole regulator chamber. Naturally, the perforated screen (diffusion plate) can be cleaned from outside using a water jet, but even this operation will carry fibers into the regulator chambers.

The construction in the aforesaid U.S. publication permits easy access to the regulator chambers, but the removal and installation of the perforated screen has turned out to be difficult. Its length corresponds essentially to the width of the web, making it quite heavy to handle.

SUMMARY OF THE INVENTION

The present invention provides a steam box, which can be easily cleaned.

More specifically, the steam box includes an elongated steam-distribution chamber, regulator chambers set in a row next to the elongated steam-distribution chamber and covered on one side with a continuous perforated screen. Operating devices are operable to distribute the steam from the distribution chamber to each regulator chamber. The steam box feeds steam through the perforated screen to a web, to heat it according to a desired profile. The steam box is characterized in that the the perforated plate is secured along one long edge to hinge members and along the opposite side to a locking member and arranged so that it can be opened to permit access to the regulator chambers.

The regulator chambers are formed in a unified elongated space by separating them from one another by means of partition walls, and the perforated screen is arranged to press directly against these partition walls.

A unified auxiliary distribution chamber on the other side of the distribution chamber equipped with another heat-distributing perforated screen and in which the distribution chamber and the auxiliary distribution chamber are covered with a unified plate, the other perforated screen being part of this unified plate.

The hinge members are installed on the outer edge side of the regulator chambers and the locking members on the distribution chamber side. The locking members comprise an axle secured rotatably to the inside of the free edge of the perforated screen, with indentations formed at regular intervals along it, and stops extending to the axle and set at corresponding intervals along the edge of the regulator chambers. The axle is arranged to be able to pass the stops at those stops that are in the indentations and to lock against the stops that have been turned to the bottom of the indentations.

The entire web-side edge of the steam box is arranged to be opened as one or more parts, with each part being secured to the aforesaid hinge members along one long edge of the steam box, the locking members being on the opposite edge.

The perforated screen, i.e. diffusion plate, which is supported on hinges, can be in one or more parts, together covering the entire width of the web. The hinges permit the screen to be opened safely and lightly by one person.

These and other features and advantages of the invention will be more fully understood from the following detailed description of the invention taken together with the accompanying drawings.

DETAILED DESCRIPTION OF THE INVENTION

Figure 1:
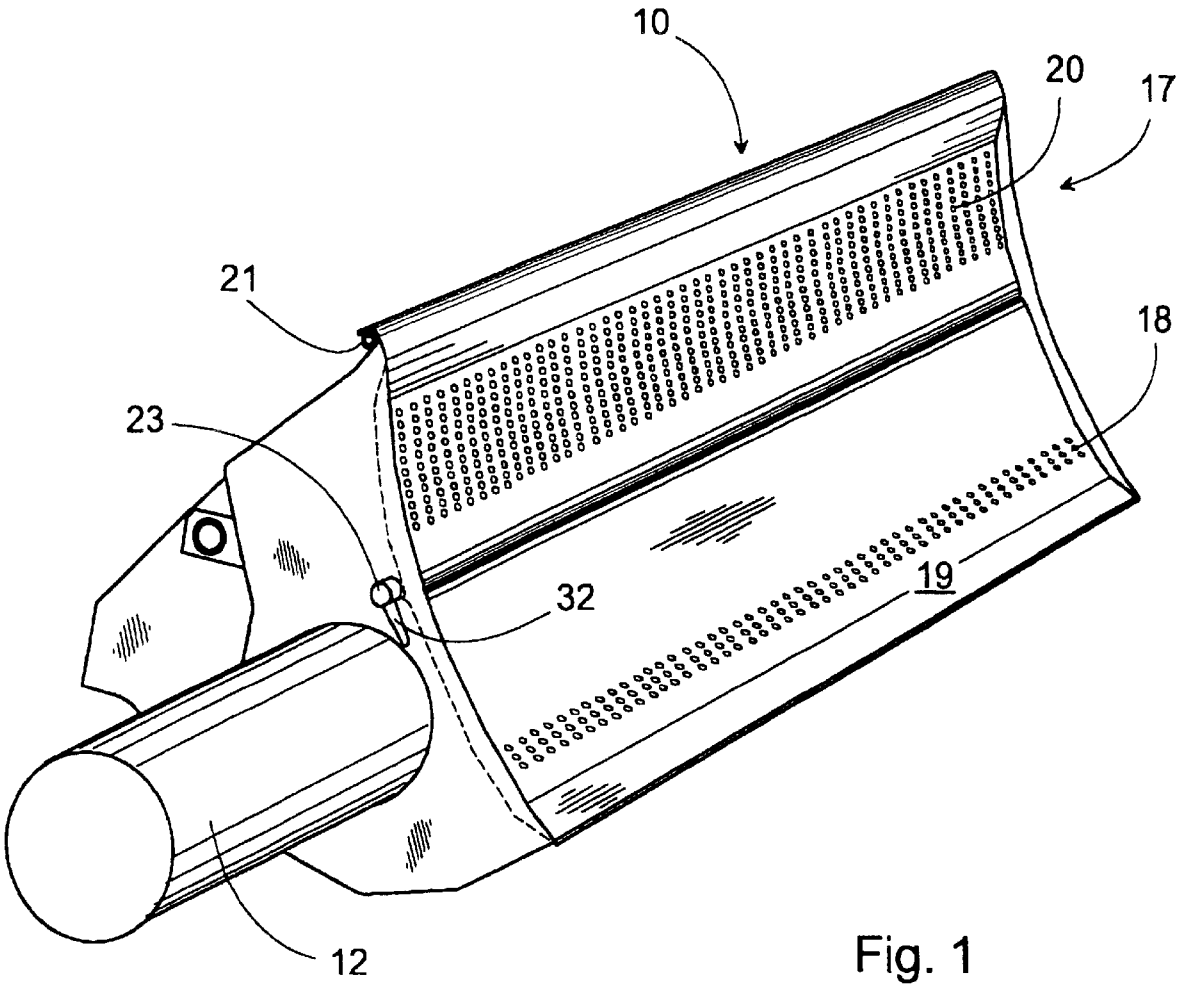
FIG. 1 shows an axonometric view of a steam box according to the invention.

Referring now to the drawings in detail, steam box 10 is set against a roll. The end-plates and long sides conform closely to the surface of the roll, allowing very little steam to escape. On the front side, in the direction of travel of the web, are regulator zones 17, by means of which the desired heating profile can be formed over the width of the web. On the exit side, there is a constant zone 18, through which an even flow of steam is directed to the web over its entire width. Hot steam is led through pipe 12 to the steam box, 90% typically going to the regulator zones and 10% to the constant zone.

The regulator zones 17 are formed of regulator chambers 15, on top of which there is a continuous perforated screen 20, which can be raised around hinge members 21. Perforated screen 20 is locked into its operating position, by means of a mechanism to be disclosed later and operated by handle 32. In this steam box, only the cover of the regulator zone, i.e. perforated screen 20, can be opened. If necessary, the second part of the front surface 19 can be arranged to open in the same way, or the entire front surface can be formed into a unified cover, covering both the regulator zones and the constant zone.

Figure 2:
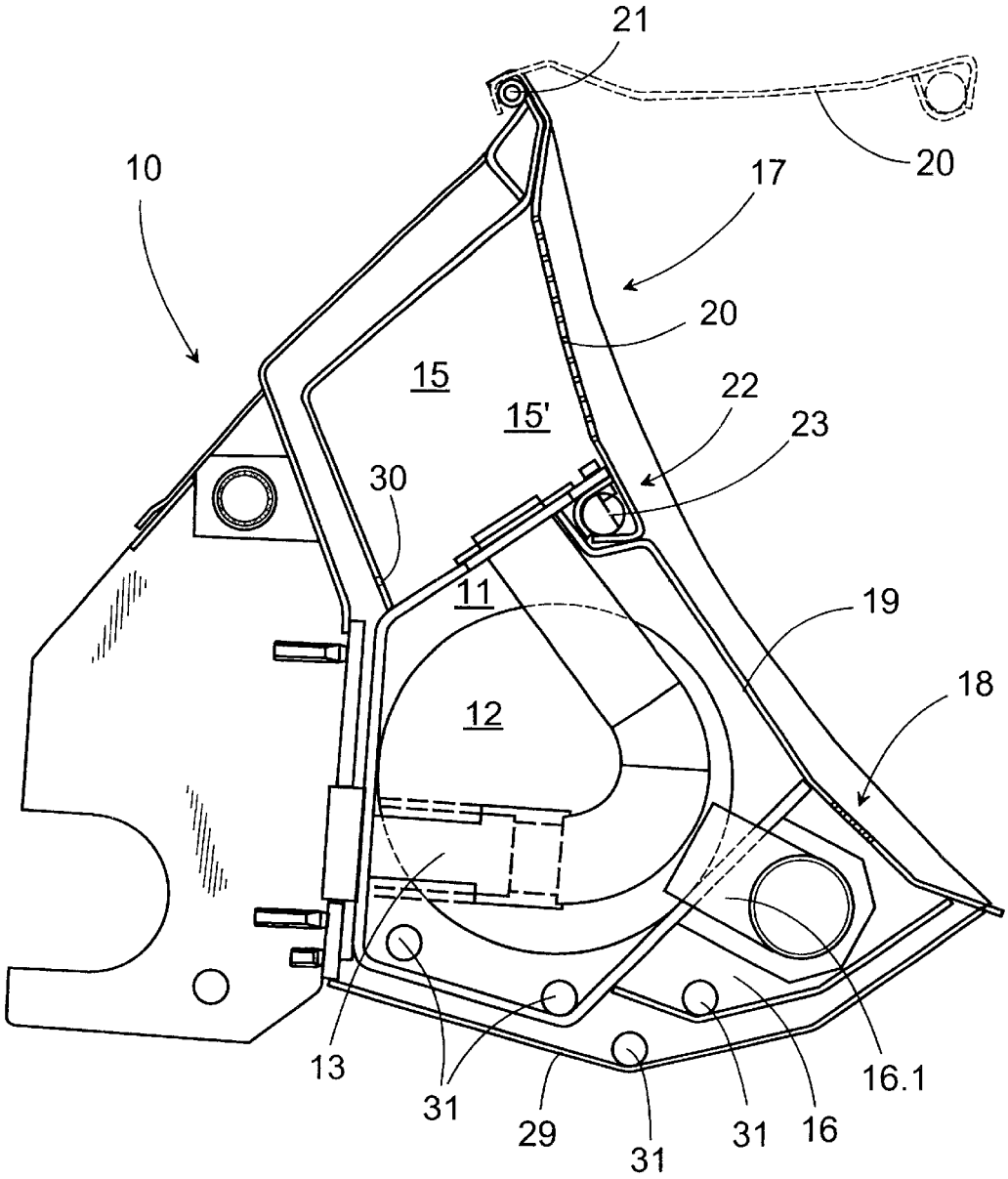
FIG. 2 shows a cross-section of the steam box of FIG. 1.
Figure 4:
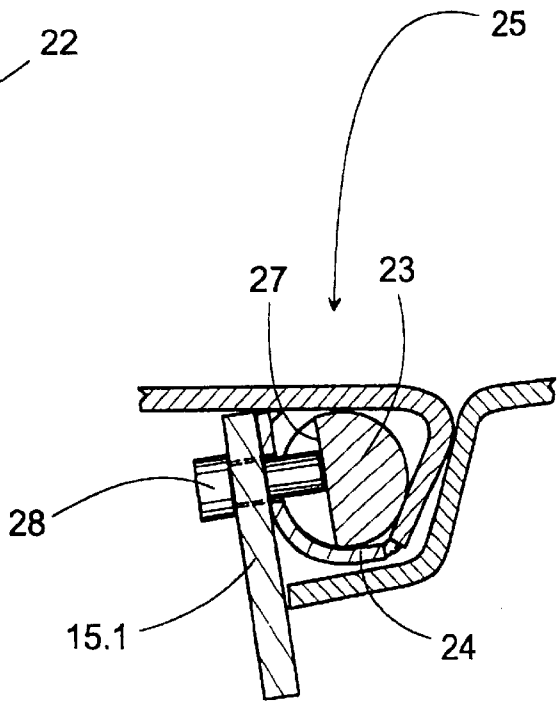
FIG. 4 shows the locking mechanism in an open position.

FIG. 2 shows the construction of the steam box. Steam is led through pipe connection 12 to the distribution chamber 11 in the center. On the front side of distribution chamber 11 are regulator chambers 15, which are formed by dividing a common elongated space into sections by means of partition walls 15'. Continuous auxiliary distribution chamber 16, which here is fed through connection 16.1, is on the other side of distribution chamber 11. Water condensing in the chambers is collected in casing 29 and condensing water removal channels 31. The rear part 10 of the steam box acts as a stiffener and attachment frame.

Steam is distributed to the regulator chambers with the aid of regulators 13 and the condensed water is removed from each regulator chamber 15 with the aid of removal connection 30. As blockage of this removal connection 30 would prevent the regulator chamber from functioning, the chambers are cleaned 1–2 times a year. To facilitate cleaning, the diffusion plate, i.e. perforated screen 20, can be opened around hinge members 21, once the locking members 22 have been opened, FIG. 2. Perforated screen 20 (perforation next to the regulator chambers) is bent at the edge and conforms to the shape of the partition walls 15' or the regulator chambers, making the chambers steam-tight when perforated screen 20 is closed.

Figure 3:
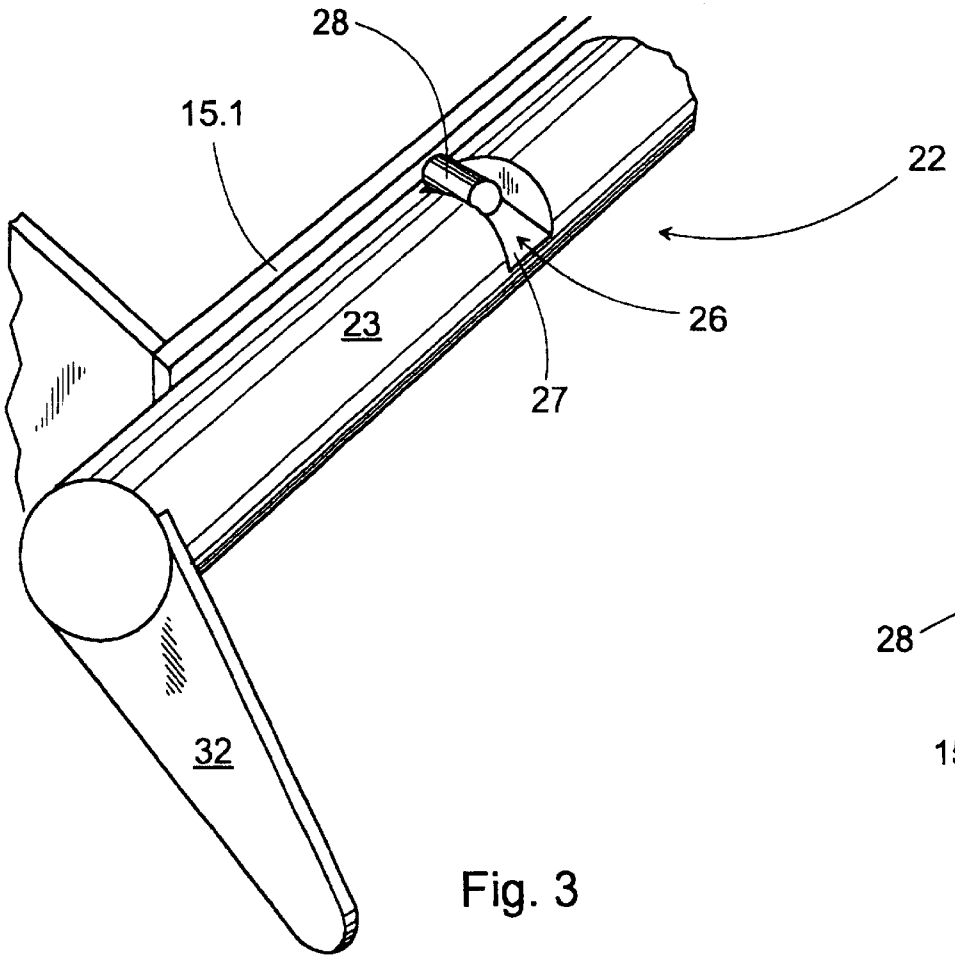
FIG. 3 shows a locking mechanism in detail.

The broken lines in FIG. 2 show perforated screen 20 in the open position, when there is unrestricted access to regulator chambers 15. For various reasons, the width of the web at perforated screen 20 can be divided into two or more parts. Thus, a steam box for a web with a width of 10 meters, can have two 5-meter wide perforated screens 20. the regulator chamber. Each pin 28 extends, according to FIG. 3, inside the axle, but not as far as the bottom surface, when indentation 26 is turned against it. Thus, according to FIG. 2, perforated screen 20 can be raised or lowered past each pin. In the closed position, axle 23 is rotated, so that the bottom surface 27 of each indentation 26 presses against pin 28.

The bottom surfaces 27 of the indentations 28 are phased, so that each locking pin 28 applies an equally great moment.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A steam box for heating a web, which includes an elongated steam-distribution chamber as a first row disposed transverse to the web, regulator chambers as a next row disposed transverse to the web and covered on one side with a continuous perforated screen on a web-side edge of the steam box, and operating devices to distribute the steam from the distribution chamber to each regulator chamber, and which steam box is operative to feed steam through the perforated screen to the web, to heat it according to the desired profile, characterized in that the said perforated screen is secured along one long edge disposed transverse to the web to hinge members and along an opposite edge to locking members and arranged so that said perforated screen can be swung open outwardly about said hinge members to permit access to the regulator chambers.

2. A steam box according to claim 1, characterized in that the regulator chambers are formed in a unified elongated space by separating them from one another by means of partition walls, and the perforated screen is arranged to press directly against these partition walls.

3. A steam box according to claim 1, characterized in that the steam box also includes a continuous auxiliary distribution chamber on the opposite side of the distribution chamber from the regulator chambers equipped with another heat distributing perforated screen and in which the distribution. chamber and the auxiliary distribution chamber are covered with a unified plate, the aforesaid other perforated screen being part of this unified plate.

4. A steam box according to claim 2, characterized in that the steam box also includes a continuous auxiliary distribution chamber on the opposite side of the distribution chamber from the regulator chambers equipped with another heat-distributing perforated screen and in which the distribution chamber and the auxiliary distribution chamber are covered with a unified plate, the aforesaid other perforated screen being part of this unified plate.

5. A steam box according to claim 1, characterized in that the locking members are attached to the edge of the distribution chamber to the side of the regulator chambers and the hinge members are attached to the opposite side to the distribution chamber.

6. A steam box according to claim 2, characterized in that the locking members are attached to the edge of the distribution chamber to the side of the regulator chambers and the hinge members are attached to the opposite side to the distribution chamber.

7. A steam box according to claim 5, characterized in that the locking members comprise an axle secured rotatably to the inside of the free edge of the perforated screen, with indentations formed at regular intervals along it, and stops extending to the axle and set at corresponding intervals along the edge of the regulator chambers, and in which the axle is arranged to be able to pass the stops at those stops that are in the indentations and to lock against the stops that have been turned to the bottom of the indentations.

8. A steam box according to claim 6, characterized in that the locking members comprise an axle secured rotatably to the inside of the free edge of the perforated screen, with indentations formed at regular intervals along it, and stops extending to the axle and set at corresponding intervals along the edge of the regulator chambers, and in which the axle is arranged to be able to pass the stops at those stops that are in the indentations and to lock against the stops that have been turned to the bottom of the indentations.

9. A steam box according to claim 1, characterized in that the entire web-side edge of the steam box is arranged to be opened as one or more parts, with each part being secured to the aforesaid hinge members along one long edge of the steam box, the locking members being on the opposite edge.

10. A steam box according to claim 2 characterized in that the entire web-side edge of the steam box is arranged to be opened as one or more parts, with each part being secured to the aforesaid hinge members along one long edge of the steam box, the locking members being on the opposite edge.

* * * * *